United States Patent [19]

Tsuzuki

[11] 4,434,628

[45] Mar. 6, 1984

[54] KNITTING NEEDLE ASSEMBLY

[75] Inventor: Takashi Tsuzuki, Kodaira, Japan

[73] Assignee: Silver Seiko Ltd., Kodaira, Japan

[21] Appl. No.: 367,935

[22] Filed: Apr. 13, 1982

[51] Int. Cl.[3] ..... D04B 35/04

[52] U.S. Cl. ..... 66/123

[58] Field of Search ..... 66/123, 124, 116, 121

[56] References Cited

U.S. PATENT DOCUMENTS

| | | | |
|---|---|---|---|
| 567,931 | 9/1896 | Woodward | 66/123 |
| 589,024 | 8/1897 | Philbrick | 66/123 |
| 664,808 | 12/1900 | Dodge | 66/123 |
| 822,401 | 6/1906 | Sturtevant | 66/123 |
| 3,699,784 | 10/1972 | Berentzen | 66/123 |
| 3,712,083 | 1/1973 | Slof et al. | 66/123 |
| 3,842,626 | 10/1974 | Stivers et al. | 66/123 |
| 3,964,274 | 6/1976 | Stivers et al. | 66/123 |

FOREIGN PATENT DOCUMENTS

| | | | |
|---|---|---|---|
| 571976 | 10/1958 | Belgium | 66/123 |

*Primary Examiner*—Ronald Feldbaum

*Attorney, Agent, or Firm*—Lane, Aitken & Kananen

[57] ABSTRACT

A knitting needle assembly suitable for use with a heavy yarn knitting apparatus. The assembly comprises an attachment of a suitable plastics material removably attached to a butt of a conventional knitting needle of a steel material. The attachment has a generally cylindrical configuration and preferably includes an inner member and a cylindrical outer member rotatably mounted on the inner member. Thus, the knitting needle presents a reduced friction against cams on a carriage of the machine.

9 Claims, 4 Drawing Figures

KNITTING NEEDLE ASSEMBLY

BACKGROUND OF THE INVENTION

This invention relates to a knitting needle for use with a hand-operated knitting apparatus for domestic use, and more particularly to a knitting needle suitable for knitting with a relatively heavy yarn.

Knitted garments such as, for example, a pullover, vest, cardigan and so on, are knitted favorably with heavy or relatively bulky yarns such as three- or four-ply yarns. Such garments are conveniently knitted on specific knitting apparatus generally called bulky or heavy yarn knitters which are available on the market. Conventional heavy yarn knitters, especially hand-operated knitters for domestic use, have knitting needles, the pitches of which are generally selected to be between 8 and 10 mm, while the needle pitch of conventional home knitters suitable for knitting with a medium size yarn is normally 4.5 mm. Obviously, as the needle pitch increases, the needle bed must have a greater length in order to accommodate the same predetermined number of knitting needles therein, resulting in a substantial increase of the weight of the entire needle bed and hence the machine.

If the needle pitch could be decreased, for example, to 6 mm, this disadvantage could be improved mitigated to some degree. But a mere reduction of the needle pitch will cause another problem: it results in a corresponding increase of the number of knitting needles which are at a time engaged with and operated by a knitting cam on the machine carriage to knit a yarn into stitches, and such an increase will make the operation of the carriage correspondingly heavier, since those knitting needles act to draw or pull a yarn supplied thereto in opposite directions relative to each other, the yarn extending in a zig zag configuration among those needles and adjacent sinker elements of the machine. Thus, in view of the cooperation between a yarn and knitting needles, the knitting cam on the carriage may preferably have a steeper inclination relative to the direction of movement of the carriage on the needle bed in order to decrease the needles which are operated at a time by the knitting cam. On the other hand, the steeper the inclination of a cam, the greater the friction thereby, as well known to those skilled in the art. Accordingly, an optimum inclination of the knitting cam will be determined by a compromise or function between the friction between the number of knitting needles which are operated at a time by the knitting cam and the friction between the knitting cam and such knitting needles.

Conventional medium size yarn knitters as mentioned above have their knitting cams disposed normally at an angle between or for movement to present an angle between 45 to 50 degrees, as an optimum value, relative to the carriage moving direction. In heavy yarn knitters on which a heavy yarn is used for knitting which provides a greater frictional resistance against the knitting needles, the knitting cams could obviously be disposed at a significantly steeper angle relative to the carriage moving direction.

Recent hand-operated home knitters progressively employ plastic materials for their machine components; even knitting cams on a machine carriage are sometimes made of a suitable synthetic resin material such as, for example, polyacetal or ABS, in order to reduce the weight of the machine and production of noises caused by collisions of such cams with butts of knitting needles.

On the contrary, knitting needles are normally made of steel material. Thus, if the carriage is operated so rapidly or strongly on the needle bed that its knitting cam is forcibly collided or pressed by butts of knitting needles, the plastics cam may possibly be damaged by the steel needle butts, and once a scar or mark is formed on the cam, it will provide a greater resistance to needle butts so that the cam will be further damaged thereby, which may cause a trouble in knitting and in the machine. The disposition of knitting cams in a steeper inclination relative to the carriage moving direction will present a corresponding increase of such harmful collisions of knitting cams by needle butts.

SUMMARY OF THE INVENTION

Accordingly, the present invention contemplates the provision of a knitting needle assembly which is suitable for use with a heavy yarn knitting apparatus and which produces reduced noises upon engagement with cams on a knitting machine carriage and presents a reduced frictional resistance against the cams on the carriage so as to enable these cams, especially knitting cams, to be disposed in a relatively steeply inclined position relative to the carriage moving direction and hence to enable the knitting needles to be disposed in the needle bed of the machine at a reduced needle pitch such as, for example, 6 mm, so that the carriage and the needle bed of the machine may be reduced in length as well as in weight.

According to one aspect of the present invention, there is provided a knitting needle assembly comprising: a knitting needle made of a suitable metal material such as steel and having a laterally extending butt formed thereon, said butt defining a groove which extends on a side along the length thereof from a base end near to a free end thereof; and a substantially cylindrical element made of a suitable plastics material and having a recess for receiving the free end of said butt therein to allow said cylindrical element to be mounted on the free end of said butt, said cylindrical element having formed on a side face thereof, which partially defines said recess, a projection adapted to fit in said groove of said butt thereby to provide said cylindrical element from being inadvertently removed from said butt.

Preferably, the cylindrical element has a substantially circular cross section.

The cylindrical element may include a first inner member having said projection formed thereon, and a second outer member in the form of a tubular cylinder mounted for rotation on and relative to said first inner member.

Preferably, the first member has a disk-formed head portion and a pair of parallel legs extending from said head portion, said legs being spaced from each other to thus partially define said recess, at least one of said legs having said projection formed on a face thereof which partially defines said recess, each of said legs having an outwardly extending lug formed at an end thereof opposite from said head of said first member, said second member being fitted around said legs between said head portion and said lugs of said first member, said legs of said second member and said first member being made deflectable laterally inwardly and outwardly.

The legs of said first member may each have on the inside at the free end thereof an inclined face which acts as a cam to deflect the leg outwardly by said butt of said needle when the needle butt is forced into said recess of said cylindrical element.

At least one of said legs of said first member may have at an outer lower part of the lug thereof an inclined face which acts as a cam to deflect the leg and the second member inwardly and outwardly, respectively, when said first member is forced into said second member.

The second member may further have formed at an axial end adjacent the inner bore thereof an inclined circumferential face which acts as a cam to deflect said legs of said first member and said second element inwardly and outwardly, respectively, when said first member is forced into said second member.

One way of carrying out the invention is described in detail below with reference to the accompanying drawings which illustrate, by way of example, one embodiment of the invention, and in which:

DETAILED DESCRIPTION OF THE PREFERRED EMBODIMENT

Figure 1:
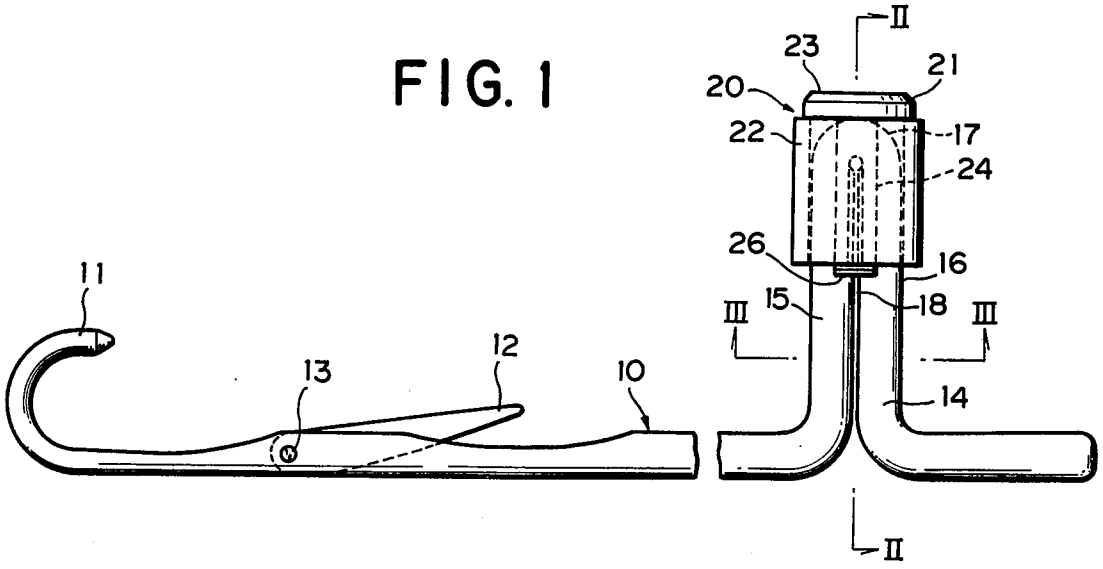
FIG. 1 is a side elevational view of a knitting needle assembly embodying the present invention.
Figure 2:
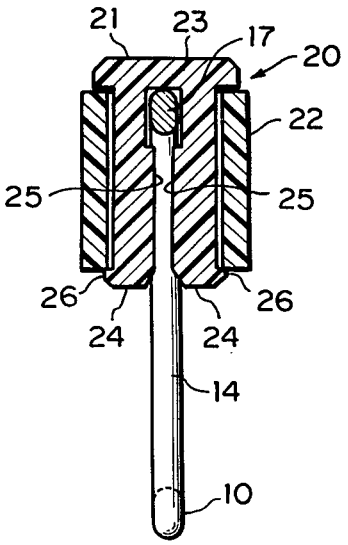
FIG. 2 is a cross sectional view substantially taken along line II—II of FIG. 1.
Figure 4:
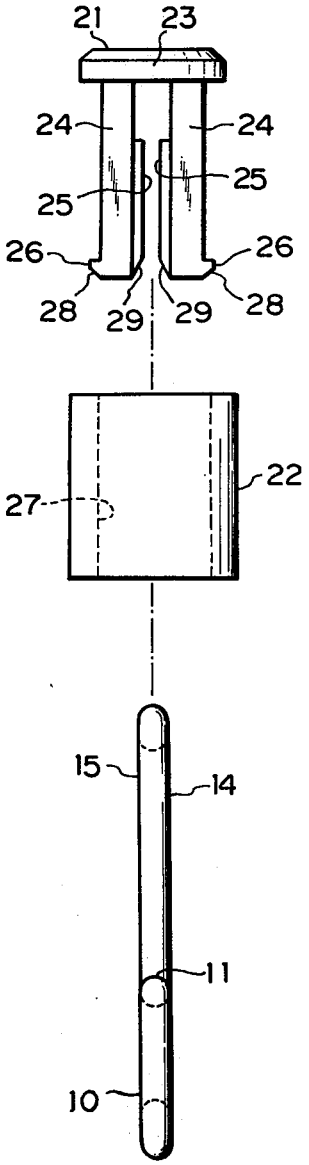
FIG. 4 is a fragmentary front elevational view showing individual components of the knitting needle assembly of FIG. 1 in disassembled position.

Referring to FIGS. 1 to 4, there is illustrated a preferred embodiment of a knitting needle assembly according to the present invention. The assembly includes a conventional latch needle, generally designated at 10, as is employed in conventional hand operated knitting apparatus for domestic use. The needle 10 is conventionally made of a metal material, such as steel, in the form of a rounded wire and has a hook 11 integrally formed at the front end thereof. A latch 12 is pivotally supported as at 13 to open and close the hook 11. The needle 10 further has a butt 14 integrally formed thereon adjacent the opposite or rear end thereof by bending the metal wire laterally into an inverted U shape. Thus, the butt 14 consists of a front vertical portion 15, a rear vertical portion 16 and an interconnecting arcuate top portion 17. The needle 10, except the hook 11 and latch 12, is laterally stamped to present a substantially elliptical cross section as represented at 15 and 16 of FIG. 3. As a result, the butt 14 presents a pair of substantially triangular grooves or spacings 18 (as seen in plan view of FIG. 3) defined by the front and rear vertical portions 15 and 16 thereof and disposed in a symmetrical relationship relative to a plane which contains the front and rear butt portions 15 and 16. The grooves 18 extend along most of the butt 14 as seen from FIG. 1.

Figure 3:
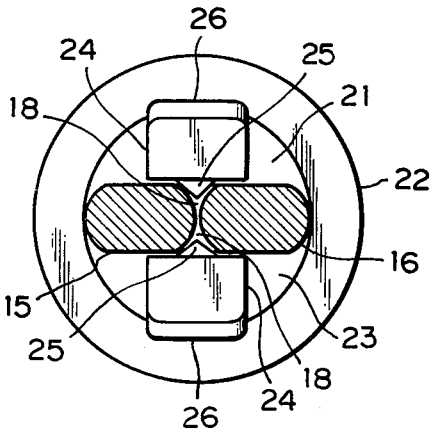
FIG. 3 is an enlarged cross sectional view substantially taken along line III—III of FIG. 1.

The knitting needle assembly further includes an attachment, generally designated at 20, which is removably attached to the butt 14 of the latch needle 10. As shown by the preferred embodiment of FIGS. 1 to 4, the attachment 20 may preferably include two separate members as generally designated at 21 and 22, respectively. The first or inner member 21 may be molded with a suitable plastics material such as, for example, nylon, polyacetal, and so on, and has a substantially disk-formed head 23 at the top thereof and a pair of legs 24 depending from the head portion 23. The legs 24 are spaced apart from each other by a distance substantially equal to or rather greater than the width of the needle 10 so that the butt may be fittedly received in the gap between both legs 24 as shown in FIG. 3. Each leg 24 has a rib 25 formed on an inner face thereof. The ribs 25 on the legs 24 are so positioned and formed that they can be fittedly received in the grooves 18 in the butt 14 of the needle 10 to allow the first member 21 to be attached to the needle butt 14 while permitting only a limited movement of the first member 21 in the vertical direction relative to the needle butt 14 as seen from FIGS. 1 to 3. An outwardly extending lug or shoulder 26 is formed at the lower extremity of each leg 24.

The second or outer member 22 of the attachment 20 to the needle butt 14 is made of a similar plastics material and is formed into a hollow cylinder having an inner bore 27 formed therein. The bore 27 of the second member 22 has a diameter slightly smaller than the diameter of the disk-formed head 23 of the first member 21 and also than the dimension between outer ends of both lugs 26 at the lower ends of the legs 24, and the second member has a height or axial length slightly smaller than the length of the legs 24 of the first member 21 when measured from the bottom face of the disk-formed head 23 to the top faces of the outer lugs 26 of the legs 24 of the first member 21 so that the second cylindrical member 22 may be retained in position in which it is rather loosely fitted on and hence rotatable around the legs 24 of the first member 21 between the head 23 and the outer lugs 26 of the first member 21.

In producing a knitting needle assembly as described above, the legs 24 of a first member 21 are first inserted into the inner bore 27 of a second member 22 in order to obtain an assembly or attachment 20 including the first and second members 21 and 22. The material of the first and second members 21 and the thickness of material at the legs 24 of the first member 21 and/or the second cylindrical member 22 may be selected to provide sufficient flexibility to the legs 24 of the first member 21 and the second cylindrical member 22 such that the legs 24 of the first member 21 and/or the second member 22 can be deflected inwardly or outwardly sufficiently to permit such insertion of the first member 21 into the second member 22. In order to facilitate such insertion, each leg 24 of the first member 21 may preferably have, at an outer lower part of the lug 26 thereof an inwardly inclined face 28 which may serve to cam the leg 24 to be deflected inwardly by the second member 22. Alternatively, an inwardly inclined circumferential face (not shown) may be formed at an axial end of the second member 22 adjacent the inner bore 27 thereof.

The thus assembled attachment 20 is then assembled to a knitting needle 10 by forcing the needle but 14 into the spacing between the legs 24 of the first member 21 surrounded by the cylindrical second member 22. To facilitate such insertion of the needle butt 14 into the spacing of the attachment 20, the rib 25 of each leg 24 is cut obliquely to present an inclined face 29 which acts as a cam to deflect the leg 24 outwardly by the needle butt 14 when the butt 14 is forced into the spacing of the attachment 20. The flexibility of the first and second members 21 again accommodates such insertion of the needle butt 14 into the attachment 20 including the first and second members 21 and 22.

Figure 5:
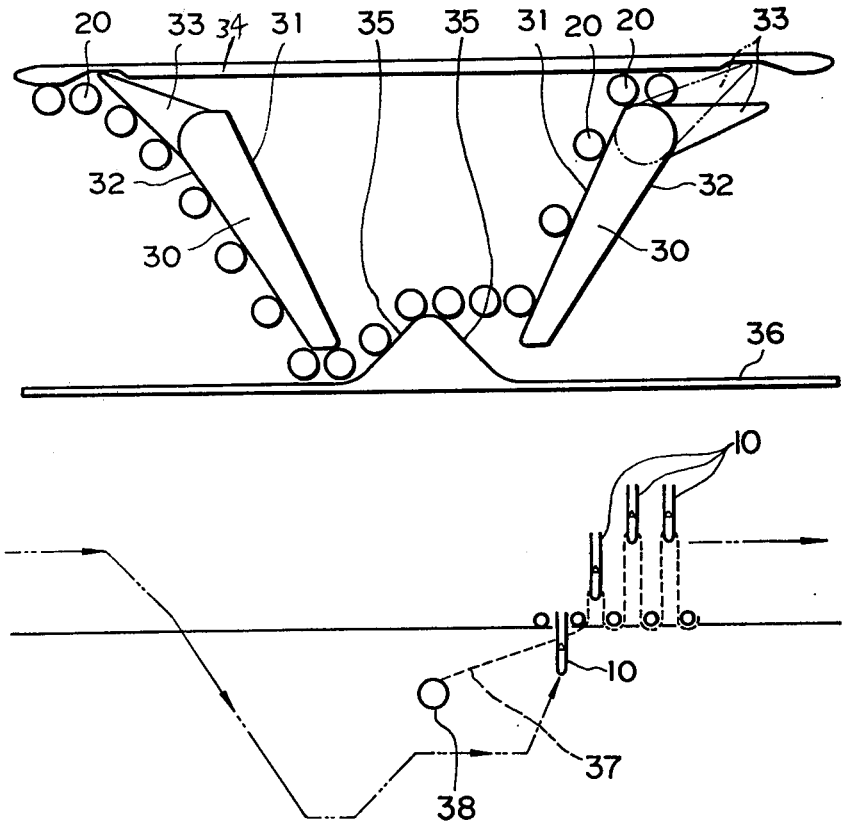
FIG. 5 is a diagrammatic illustration showing cooperation of knitting needles with a knitting yarn and a cam arrangement on a carriage of a knitting machine which employs knitting needle assemblies according to the present invention.

Referring now to FIG. 5, there is illustrated, in diagrammatical representation, an exemplary cam arrangement of a carriage for a hand-operated knitting machine which can be attained with knitting needle assemblies according to the present invention. The cam arrangement of FIG. 5 is shown as including a pair of knitting cams 30 which each have a retracting or knitting cam edge 31 and an advancing cam edge 32. Each knitting cam 30 is mounted for displacement or adjustment so as to vary its angular position relative to the direction of movement of the carriage across the needle bed. In FIG. 5, the cam 30 is shown in its greatest angular position and thus the lowering cam edge 31 thereof has an angle of approximately 65 degrees to the direction of carriage movement. On the other hand, in FIG. 5, knitting needles are shown as being disposed substantially in the pitch of 6 mm.

When the carriage is moved across the needle bed, i.e., in the leftward or rightward direction as viewed in FIG. 5, needle butt attachments 20 are first advanced by an axuiliary cam 33, which is pivotally mounted at the rear end of each knitting cam 30 and spring-urged against a rear partition cam 34, and then by the advancing cam edge 32 of the knitting cam 30 contiguous to the auxiliary cam 33. They are then retracted a little by a retracting cam edge 35 of a center cam portion of a front partition cam 36 and then further retracted by the retracting cam edge 31 of the opposite knitting cam 30 whereafter they open and clear the contiguous auxiliary cam 33. While the knitting needles 10 are being retracted by the retracting cam edge 31 of the latter knitting cam 30, a knitting yarn such as designated by 37 is supplied from a yarn feeder (only a hole or eye 38 for releasing a yarn therethrough is shown in FIG. 5) in the hooks of the knitting needles and is drawn by the latter to form new stitches thereof on those needles in a manner well known to those skilled in the art. It is to be noted that only two knitting needles having a yarn supplied thereon may be retracted at a time for formation of new stitches by a pertinent knitting cam 30, resulting in reduction of a force necessary for moving the carriage across the needle bed.

It is also noted that outer cylindrical members 15 of needle butt attachments may rotate around associated inner members 10 while they are engaged with and advanced or retracted by cams on the carriage, resulting in reduction of friction between needle butts and the cams and hence in reduction of a force necessary for operation of the carriage.

Although the invention has been described with a certain degree of particularity, it is understood that the present disclosure has been made only by way of example and that numerous changes in the details of construction and the combination and arrangement of parts may be made without departing from the spirit and scope of the invention as hereinafter claimed.

I claim:

1. A knitting needle assembly comprising:

a knitting needle made of a metal material and having a laterally extending butt formed thereon, said butt defining a groove which extends on a side along the length thereof from a base end near to a free end thereof; and an attachment made of a plastic material and comprising a substantially cylindrical outer member and an inner member, said outer member defining an inner bore in which said inner member is retained, wherein said inner and outer members define a recess for receiving the free end of said butt therein to allow said members to be mounted on the free end of said butt, said inner member having formed on an inside surface thereof, which partially defines said recess, a projection adapted to fit in said groove of said butt thereby to prevent said members from being inadvertently removed from said butt.

2. A knitting needle assembly as claimed in claim 1, wherein an outer cylindrical surface of said attachment has a substantially circular cross section.

3. A knitting needle assembly as claimed in claim 1, wherein said attachment includes a first inner member having said projection formed thereon, and a second outer member in the form of a tubular cylinder mounted for rotation on and relative to said first inner member.

4. A knitting needle assembly as claimed in claim 3, wherein said first member has a disk-formed head portion and a pair of parallel legs extending from said head portion, said legs being spaced from each other to thus partially define said recess, at least one of said legs having said projection formed on a face thereof which partially defines said recess, each of said legs having an outwardly extending lug formed at an end thereof opposite from said head of said first member, said second member being fitted around said legs between said head portion and said lugs of said first member, said legs of said second member and said first member being made deflectable laterally inwardly and outwardly, respectively.

5. A knitting machine as claimed in claim 4, wherein said legs of said first member each have on the inside at the free end thereof an inclined face which acts as a cam to deflect the leg outwardly by said butt of said needle when the needle butt is forced into said recess of said attachment.

6. A knitting needle assembly as claimed in claim 4 or 5, wherein at least one of said legs of said first member has at an outer lower part of the lug thereof an inclined face which acts as a cam to deflect the leg and the second member inwardly and outwardly, respectively, when said first member is forced into said second member.

7. A knitting needle assembly as claimed in claims 4 or 5, wherein said second member defines an inner bore and has formed at an axial end adjacent the inner bore an inclined circumferential face which acts as a cam to deflect said legs of said first member and said second element inwardly and outwardly, respectively, when said first member is forced into said second member.

8. A knitting needle assembly as claimed in claim 6, wherein said second member defines an inner bore and has formed at an axial end adjacent the inner bore an inclined circumferential face which acts as a cam to deflect said legs of said first member and said second element inwardly and outwardly, respectively, when said first member is forced into said second member.

9. A knitting needle assembly as claimed in claim 1, wherein said metal material is steel.

* * * * *

UNITED STATES PATENT AND TRADEMARK OFFICE

CERTIFICATE OF CORRECTION

PATENT NO. : 4,434,628

DATED : March 6, 1984

INVENTOR(S) : TAKASHI TSUZUKI

It is certified that error appears in the above—identified patent and that said Letters Patent is hereby corrected as shown below:

Column 1, line 27, delete "improved".

Column 2, line 43, "provide" should read -- prevent --.

Column 4, line 7, after "butt" insert -- 14 --.

Column 6, line 33, "second" should read -- first -- and "first" should read -- second --.

Signed and Sealed this

*Twenty-fifth* Day of *September 1984*

[SEAL]

*Attest:*

GERALD J. MOSSINGHOFF

*Attesting Officer*

*Commissioner of Patents and Trademarks*